United States Patent [19]

Staggs

[11] Patent Number: 4,721,557

[45] Date of Patent: Jan. 26, 1988

[54] COMBINATION PROCESS FOR THE CONVERSION OF A RESIDUAL ASPHALTENE-CONTAINING HYDROCARBONACEOUS STREAM TO MAXIMIZE MIDDLE DISTILLATE PRODUCTION

[75] Inventor: Darrell W. Staggs, Hoffman Estates, Ill.

[73] Assignee: UOP Inc., Des Plaines, Ill.

[21] Appl. No.: 916,754

[22] Filed: Oct. 8, 1986

[51] Int. Cl.[4] ..... C10G 49/00

[52] U.S. Cl. ..... 208/68; 208/75; 208/76; 208/77; 208/96

[58] Field of Search ..... 208/61, 67, 68, 73, 208/76, 77, 96, 89, 86, 112

[56] References Cited

U.S. PATENT DOCUMENTS

| | | | |
|---|---|---|---|
| 2,096,458 | 12/1959 | Strickland | 208/73 X |
| 3,594,309 | 7/1971 | Stolfa | 208/89 |
| 3,598,720 | 8/1971 | Stolfa | 208/61 |
| 3,730,875 | 5/1973 | Gleim et al. | 208/61 X |
| 3,775,293 | 11/1973 | Watkins | 208/86 |
| 4,181,601 | 1/1980 | Sze | 208/57 |
| 4,201,659 | 5/1980 | Kuant et al. | 208/77 X |
| 4,324,395 | 4/1982 | Wernicke et al. | 585/314 |
| 4,400,264 | 8/1963 | Kuant et al. | 208/68 |
| 4,405,441 | 9/1983 | Van Dongon et al. | 208/68 X |

*Primary Examiner*—Curtis R. Davis
*Assistant Examiner*—Glenn Caldarola
*Attorney, Agent, or Firm*—Thomas K. McBride; John F. Spears, Jr.; John G. Cutts, Jr.

[57] ABSTRACT

A process for the conversion of residual asphaltene-containing hydrocarbonaceous charge stock to selectively produce large quantities of high quality middle distillate while minimizing hydrogen consumption.

20 Claims, 1 Drawing Figure

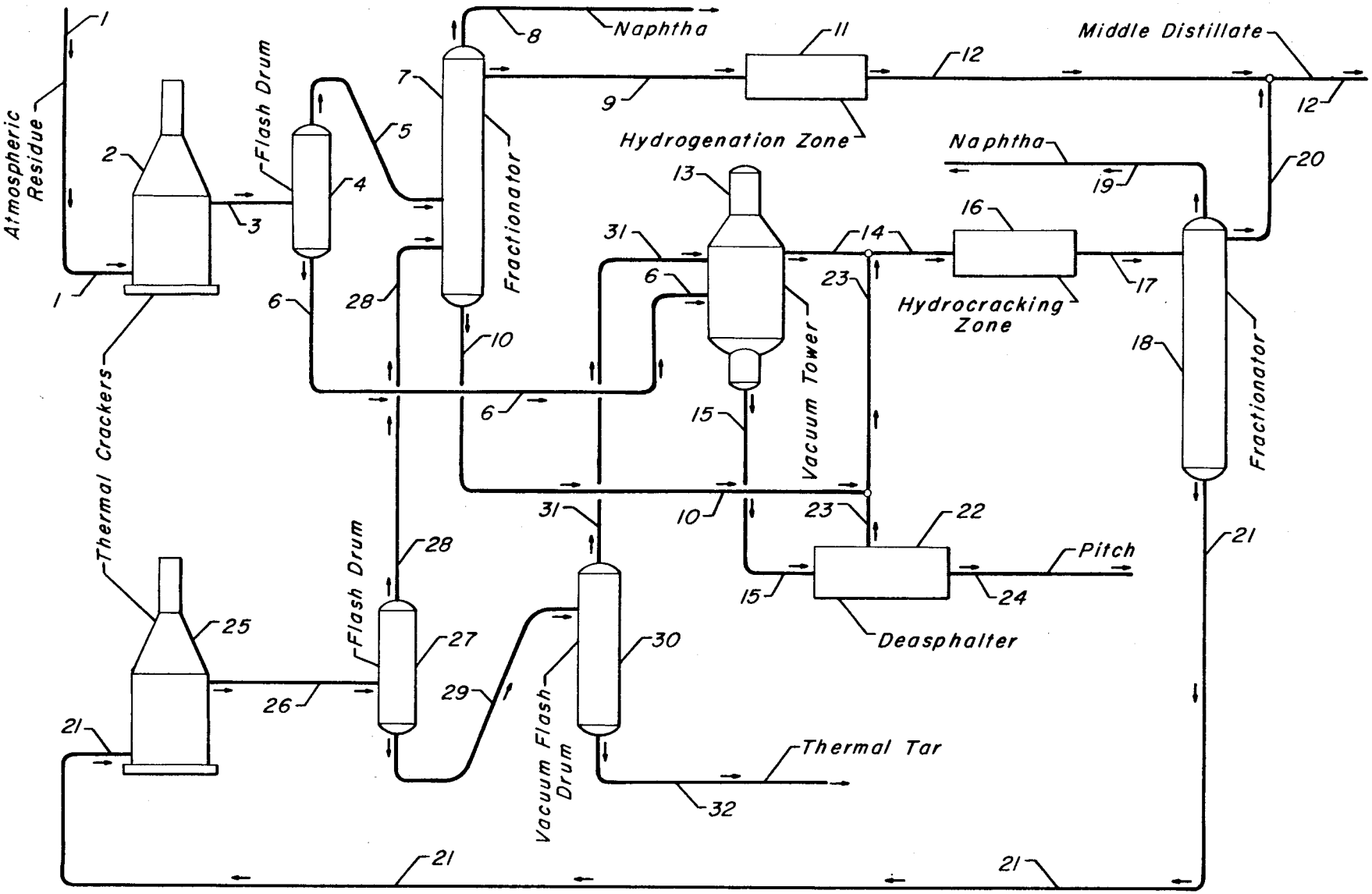
Middle Distillate
Naphtha
Hydrogenation Zone
Naphtha
Fractionator
Hydrocracking Zone
Fractionator
Vacuum Tower
Pitch
Deasphalter
Thermal Tar
Vacuum Flash Drum
Flash Drum
Flash Drum
Thermal Crackers
Atmospheric Residue

COMBINATION PROCESS FOR THE CONVERSION OF A RESIDUAL ASPHALTENE-CONTAINING HYDROCARBONACEOUS STREAM TO MAXIMIZE MIDDLE DISTILLATE PRODUCTION

BACKGROUND OF THE INVENTION

The field of art to which this invention pertains is the maximization of high quality middle distillate from residual asphaltene-containing hydrocarbonaceous streams. More specifically, the invention relates to a process for the conversion of residual asphaltene-containing hydrocarbonaceous charge stock to selectively produce large quantities of high quality middle distillate while minimizing hydrogen consumption.

INFORMATION DISCLOSURE

In U.S. Pat. No. 3,730,875 (Gleim et al.), a process is disclosed for the conversion of an asphaltene-containing hydrocarbonaceous charge stock into lower-boiling hydrocarbon products which comprises (a) reacting the charge stock with hydrogen in a catalytic hydrogenation reaction zone; (b) further reacting the resulting hydrogenated effluent, in a non-catalytic thermal reaction zone; and (c) reacting at least a portion of the resulting normally liquid, thermally-cracked effluent, in a catalytic hydrocracking reaction zone. The '875 patent also teaches that a portion of a hydrocracker effluent may be recycled to the hydrogenation zone.

In U.S. Pat. No. 3,594,309 (Stolfa), a process is disclosed for the conversion of an asphaltene-containing hydrocarbonaceous charge stock into lower-boiling hydrocarbon products which comprise (a) reacting the charge stock with hydrogen in a catalytic reaction zone; (b) cracking at least a portion of the catalytic reaction zone effluent in a non-catalytic reaction zone; and (c) recycling a slop wax stream resulting from the non-catalytic reaction zone to the catalytic reaction zone of step (a). The slop wax stream is characterized as boiling in a temperature range above that of the vacuum gas oils and within a temperature range of about 980° F. (526° C.) to about 1150° F. (620° C.)

In U.S. Pat. No. 3,775,293 (Watkins), a method is disclosed for reacting a hydrocarbonaceous resin with hydrogen, in a catalytic hydrocracking reaction zone, at hydrocracking conditions selected to convert resin into lower-boiling hydrocarbon; further reacting at least a portion of the hydrocracking effluent in a non-catalytic reaction zone, at thermal cracking conditions, and reacting at least a portion of the resulting thermally cracked product effluent in a separate catalytic reaction zone, with hydrogen, at hydrocracking conditions. Hydrocarbonaceous resins are considered to be non-distillable with boiling points greater than about 1050° F. (565° C.).

Furthermore, the hydrogenation of a thermal cracking feedstock is disclosed in U.S. Pat. No. 4,181,601 (Sze) and U.S. Pat. No. 4,324,935 (Wernicke et al.).

BRIEF SUMMARY OF THE INVENTION

The invention provides an integrated process for the conversion of a residual asphaltene-containing hydrocarbonaceous charge stock to selectively produce large quantities of high quality middle distillate while minimizing hydrogen consumption by converting the residual asphaltene-containing hydrocarbonaceous charge stock in a multiplicity of hydrocarbonaceous conversion zones all of which are designed and combined in order to maximize the production of middle distillate while simultaneously minimizing hydrogen consumption and production of unwanted hydrocarbonaceous by-product streams.

One embodiment of the invention may be characterized as a process for the conversion of a residual asphaltene-containing hydrocarbonaceous charge stock to selectively produce large quantities of high quality middle distillate while minimizing hydrogen consumption which process comprises the steps of: (a) reacting the residual asphaltene-containing hydrocarbonaceous charge stock in a first non-catalytic thermal reaction zone at thermal cracking conditions including an elevated temperature from about 700° F. (371° C.) to about 950° F. (510° C.), a pressure from about 15 psig (103 kPa gauge) to about 100 psig (689 kPa gauge) and an equivalent residence time at 900° F. (482° C.) from about 2 to about 30 seconds to provide a first non-catalytic thermal reaction zone effluent; (b) passing the first non-catalytic thermal reaction zone effluent into a first separation zone operated at conditions which result in the separation of entering hydrocarbonaceous compounds to provide a first middle distillate stream having olefinic hydrocarbonaceous compounds, a first distillate hydrocarbonaceous stream boiling at a temperature greater than about 700° F. (371° C.) and a first non-distillable hydrocarbonaceous stream; (c) hydrotreating the first middle distillate stream having olefinic hydrocarbonaceous compounds recovered in step (b) in a catalytic hydrotreating reaction zone at hydrotreating conditions to saturate at least a portion of the olefinic hydrocarbonaceous compounds to provide a first high quality middle distillate product stream; (d) reacting the first distillate hydrocarbonaceous stream boiling at a temperature greater than about 700° F. (371° C.) with hydrogen, in a catalytic hydrocracking reaction zone, at hydrocracking conditions including a maximum catalyst bed temperature in the range of about 600° F. (315° C.) to about 850° F. (454° C.) selected to convert at least a portion of the first distillate hydrocarbonaceous stream to lower-boiling hydrocarbonaceous products; (e) deasphalting the first non-distillable hydrocarbonaceous stream in a deasphalting zone at deasphalting conditions to produce a deasphalted oil stream and a pitch stream; (f) reacting the deasphalted oil stream in the catalytic hydrocracking reaction zone of step (d); (g) separating a hydrocarbonaceous effluent stream produced in the catalytic hydrocracking zone of step (d) to provide a second high quality middle distillate product stream and a hydrocarbonaceous stream boiling at a temperature greater than about 700° F. (371° C.) and comprising non-distillable deasphalted oil; (h) reacting the hydrocarbonaceous stream boiling at a temperature greater than about 700' F. (371° C.) and comprising non-distillable deasphalted oil in a second non-catalytic thermal reaction zone at thermal cracking conditions including an elevated temperature from about 700° F. (371° C.) to about 950° F. (510° C.), a pressure from about 50 psig (345 kPa gauge) to about 400 psig (2756 kPa gauge) and an equivalent residence time at 900° F. (482° C.) from about 5 to about 90 seconds to provide a second non-catalytic thermal reaction zone effluent; (i) passing the second non-catalytic thermal reaction zone effluent into a second separation zone operated at conditions to provide a thermal tar stream, a second middle distillate steam having olefinic hydrocarbonaceous compounds, and a second distillate hydrocarbon steam boiling at a temperature greater than about 700° F. (371° C.); (j) passing at least a portion of the second middle distillate steam having olefinic hydrocarbonaceous compounds into the first separation zone; and (k) passing at least a portion of the second distillate hydrocarbon stream boiling at a temperature greater than about 700° F. (371° C.) into the first separation zone.

Another embodiment of the invention may be characterized as a process for the conversion of a residual asphaltene-containing hydrocarbonaceous charge stock to selectively produce large quantities of high quality middle distillate while minimizing hydrogen consumption which process comprises the steps of: (a) reacting the residual asphaltene-containing hydrocarbonaceous charge stock in a first non-catalytic thermal reaction zone at thermal cracking conditions including an elevated temperature from about 700° F. (371° C.) to about 950° F. (510° C.) a pressure from about 15 psig (103 kPa gauge) to about 100 psig (689 kPa gauge) and an equivalent residence time at 900° F. (482° C.) from about 2 to about 30 seconds to provide a first non-catalytic thermal reaction zone effluent; (b) separating the first non-catalytic thermal reaction zone effluent to provide a first middle distillate stream having olefinic hydrocarbonaceous compounds, a first distillate hydrocarbonaceous stream boiling at a temperature greater than about 700° F. (371° C.) and a first non-distillable hydrocarbonaceous stream; (c) hydrotreating the first middle distillate stream having olefinic hydrocarbonaceous compounds recovered in step (b) in a catalytic hydrotreating reaction zone at hydrotreating conditions to saturate at least a portion of the olefinic hydrocarbonaceous compounds to provide a first high quality middle distillate product stream; (d) reacting the first distillate hydrocarbonaceous stream boiling at a temperature greater than about 700° F. (371° C.) with hydrogen, in a catalytic hydrocracking reaction zone, at hydrocracking conditions including a maximum catalyst bed temperature in the range of about 600° F. (315° C.) to about 850° F. (454° C.) selected to convert at least a portion of the first distillate hydrocarbonaceous stream to lower-boiling hydrocarbonaceous products; (e) deasphalting the first non-distillable hydrocarbonaceous stream in a deasphalting zone at deasphalting conditions to produce a deasphalted oil stream and a pitch stream; (f) reacting the deasphalted oil stream in the catalytic hydrocracking reaction zone of step (d); (g) separating a hydrocarbonaceous effluent stream produced in the catalytic hydrocracking zone of step (d) to provide a second high quality middle distillate product stream and a hydrocarbonaceous stream boiling at a temperature greater than about 700° F. (371° C.) and comprising non-distillable deasphalted oil; (h) reacting the hydrocarbonaceous stream boiling at a temperature greater than about 700° F. (371° C.) and comprising non-distillable deasphalted oil in a second non-catalytic thermal reaction zone at thermal cracking conditions including an elevated temperature from about 700° F. (371° C.) to about 950° F. (510° C.), a pressure from about 50 psig (345 kPa gauge) to about 400 psig (2756 kPa gauge) and an equivalent residence time at 900° F. (482° C.) from about 5 to about 90 seconds to provide a second non-catalytic thermal reaction zone effluent; (i) separating the second non-catalytic thermal reaction zone effluent to provide a thermal tar stream, a second middle distillate stream having olefinic hydrocarbonaceous compounds, and a second distillate hydrocarbon stream boiling at a temperature greater than about 700° F. (371° C.); (j) hydrotreating at least a portion of the second middle distillate stream having olefinic hydrocarbonaceous compounds in the catalytic hydrotreating reaction zone of step (c); and (k) reacting at least a portion of the second distillate stream boiling above about 700° F. (371° C.) from step (i) in the catalytic hydrocracking reaction zone of step (d).

Other embodiments of the present invention encompass further details such as feedstocks, hydrocracking and hydrogenation catalysts, deasphalting solvents, and operating conditions, all of which are hereinafter disclosed in the following discussion of each of these facets of the invention.

BRIEF DESCRIPTION OF THE DRAWING

The drawing is a simplified schematic process flow diagram of a preferred embodiment of the present invention.

DETAILED DESCRIPTION OF THE INVENTION

There is a steadily increasing demand for high quality middle distillate products boiling in the range of about 300° F. (149° C.)–700° F. (371° C.) Such products include, for example, aviation turbine fuel, diesel fuels, heating oils, solvents, and the like. In order to satisfy the demand for these products, a plethora of catalytic hydrocracking processes have been developed. However, catalytic hydrocracking has been previously aimed primarily at the production of lower boiling products such as gasoline and highly active catalysts have been developed for that purpose. These catalysts usually comprise a highly acidic cracking base such as hydrogen Y zeolite or silica-alumina co-gel, upon which is deposited a suitable hydrogenation metal component. By utilizing these earlier catalysts in hydrocracking processes for the conversion of heavy oils boiling above about 700° F. (371° C.) to middle distillate products, the selectivity to middle distillate was much less than desirable. Under hydrocracking conditions which were severe enough to give economical conversion of the feedstock, a large proportion of the feedstock was converted to products boiling below about 400° F. (204° C.) thereby reducing the yield of middle distillate products. Enhanced yield of middle distillate products could be achieved, however, with improved middle distillate hydrocracking catalysts, but this method of conventional hydrocracking is expensive and, in many instances, uneconomical. For example, with a conventional hydrocracking process producing equivalent overall middle distillate yields relative to the process of the present invention, the advantages enjoyed by the present invention are (1) lower capital costs, (2) lower hydrogen consumption, and (3) minimal loss of middle distillate in spite of the significantly lower hydrogen consumption.

The contemporary technology, as acknowledged hereinabove, teaches that asphaltene-containing hydrocarbonaceous charge stock and non-distillable hydrocarbonaceous charge stock boiling at a temperature greater than about 1050° F. (565° C.) may be charged to a hydrogenation or hydrocracking reaction zone and that at least a portion of the effluent from the hydrogenation or hydrocracking reaction zone may be charged to a non-catalytic thermal reaction zone. This technology has broadly caused the production of lower boiling hydrocarbons. However, the present technology has not recognized that large quantities of high quality middle distillate may be produced with minimal hydrogen consumption by the conversion of a residual asphaltene-containing hydrocarbonaceous charge stock in an integrated process.

With an increased demand for middle distillate product from heavy hydrocarbonaceous feedstock, more economical and selective processes for the conversion of heavy hydrocarbons have been sought. I have discovered, quite surprisingly, an integrated process which is highly selective towards the production of middle distillate with a residual asphaltene-containing hydrocarbonaceous charge stock. The integrated process of the present invention has lower capital costs, improved selectivity to middle distillate products and reduced hydrogen consumption when compared with processes of the prior art.

The present invention provides an improved integrated process to produce significant quantities of middle distillate with low hydrogen consumption while simultaneously minimizing large yields of normally gaseous hydrocarbons, naphtha and thermal tar. For purposes of the subject invention, the term "middle distillate product" generally refers to a hydrocarbonaceous product while boils in the range of about 300° F. (149° C.) to about 700° F. (371° C.)

The hydrocarbon charge stock subject to processing in accordance with the process of the present invention is suitably a hydrocarbonaceous oil residue obtained by atmospheric distillation. During the atmospheric distillation of crude oil, as employed on a large scale in the refineries for the production of light hydrocarbon oil distillates, a residual oil containing asphaltenes is obtained as a by-product. In some cases, this residual oil is suitable to serve as base, i.e., starting material for the production of lubricating oil, but often the residual oil, which, as a rule, contains considerable quantities of asphaltenes, sulfur, and metal, only qualifies for use as fuel oil. In accordance with the process of the present invention, such hydrocarbonaceous oil residues may be advantageously converted into large quantities of middle distillates. For purposes of the present invention, the hydrocarbonaceous oil residue preferably has an initial boiling point in the range from about 700° F. (371° C.) to about 1050° F. (565° C.) and contains significant quantities of asphaltenes by virtue of the fact that it is a residual fraction of crude oil. In addition, the hydrocarbonaceous oil residue charge stock may also contain significant quantities of hydrocarbonaceous components which boil at a temperature greater than about 1050° F. (565° C.) Suitable residual hydrocarbonaceous charge stocks also include hydrocarbons derived from tar sand, oil shale and coal.

In accordance with the present invention a residual asphaltene-containing hydrocarbonaceous charge stock is reacted in a first non-catalytic thermal reaction zone, or what may be called a visbreaker, at thermal cracking conditions including an elevated temperature in the range of about 700° F. (371° C.) to about 950° F. (510° C.), a pressure from about 15 psig (103 kPa gauge) to about 500 psig (3447 kPa gauge) and an equivalent residence time at 900° F. (482° C.) from about 1 to about 45 seconds and more preferably from about 2 to about 30 seconds. More preferably, the non-catalytic thermal reaction zone is conducted at a pressure from about 15 psig (103 kPa gauge) to about 100 psig (689 kPa gauge).

Although the residence time in the non-catalytic thermal reaction zone is specified as an equivalent residence time at 900° F. (482° C.), the actual operating temperature of the thermal reaction zone may be selected from a temperature in the range of about 700° F. (371° C.) to about 950° F. (510° C.). The conversion of the charge stock proceeds via a time-temperature relationship. Thus, for a given charge stock and a particular desired conversion level, a certain residence time at some elevated temperature is required. For the sake of a standard reference, the residence time, as described herein, is referred to as equivalent residence time at 900° F. (482° C.). For a thermal reaction zone temperature other than 900° F. (482° C.), the corresponding residence time can be determined using the equivalent time at 900° F., the Arrhenius equation and the reaction rate equation.

The Arrhenius equation is represented as $$K = Ae^{-E/RT}$$

where

K is the rection rate constant
K is the reaction rate constant
E is the activation energy
A is the frequency factor and
T is the temperature
R is the universal gas constant The reaction rate equation can be expressed in the form:

$$dx/dt = K(100-x)$$

or, upon integration $$\ln (100/100-x) = Kt$$

where

K is the reaction rate constant defined as the percent converted per unit time per percent of the original reactant present
t is time
x is conversion expressed as a percent of the original reactant For a thermal reaction zone temperature other than 900° F. (482° C.), the reaction rate constant, K, will vary with temperature according to the hereinabove-mentioned Arrhenius equation. From the above reaction rate equation and the Arrhenius equation, it can be seen how to relate equivalent time at 900° F. to residence time at a thermal reaction zone temperature other than 900° F., while maintaining a constant level of conversion.

In accordance with the present invention, the first non-catalytic thermal reaction zone is preferably operated at a relatively low severity in order to produce a maximum yield of hydrocarbonaceous products in the middle distillate boiling range and to prevent formation of coke products in downstream equipment. Therefore, the first thermal reaction zone is preferably operated with an equivalent residence time at 900° F. (482° C.) from about 1 to about 45 seconds and more preferably from about 2 to about 30 seconds.

The resulting effluent from the first non-catalytic thermal reaction zone is preferably separated to provide a low boiling hydrocarbon stream comprising naphtha and lower boiling hydrocarbons, a middle distillate stream having olefinic hydrocarbonaceous compounds, a distillate hydrocarbonaceous stream boiling at a temperature greater than about 700° F. (371° C.) and a non-distillable hydrocarbonaceous stream. A preferred method for the separation of the effluent from the first non-catalytic thermal reaction zone is to introduce the effluent stream into a flash drum which is preferably maintained at an elevated temperature which is below the temperature maintained in the thermal reaction zone and further selected to provide an overhead stream which comprises hydrocarbonaceous compounds boiling at a temperature from about 700° F. (371° C.) to about 1050° F. (565° C.) and a flash drum bottoms stream comprising non-distillable hydrocarbonaceous compounds. The flash drum overhead stream is preferably introduced into a separation zone comprising a fractional distillation column to provide a low boiling hydrocarbonaceous stream comprising naphtha and lower boiling hydrocarbons, a middle distillate stream having olefinic hydrocarbonaceous compounds and boiling in the range of about 300° F. (149° C.) to about 700° F. (371° C.), and a distillable bottoms stream boiling at a temperature greater than about 700° F. (371° C.).

The resulting middle distillate stream having olefinic hydrocarbonaceous compounds is introduced into a hydrogenation zone wherein the middle distillate stream is subjected to catalytic hydrotreating at hydrotreating conditions selected to saturate at least a portion of the olefinic hydrocarbonaceous compounds. This hydrogenation is conducted in the presence of hydrogen and is preferably maintained at conditions which include an imposed pressure of from about 500 psig (3447 kPa gauge) to about 3000 psig (20,685 kPa gauge) and more preferably under a pressure from about 500 psig (3447 kPa gauge) to about 1600 psig (11,032 kPa gauge), a maximum catalyst bed temperature in the range of about 600° F. (315° C.) to about 850° F. (454° C.), a liquid hourly space velocity in the range from about 0.2 $hr^{-1}$ to about 10 $hr^{-1}$ and a hydrogen circulation rate from about 500 SCFB (88.9 standard $m^3/m^3$) to about 10,000 SCFB (1778 standard $m^3/m^3$).

The catalytic composite disposed within the hydrogenation zone can be characterized as containing a metallic component having hydrogenation activity, which component is combined with a suitable refractory inorganic oxide carrier material of either synthetic or natural origin. The precise composition and method of manufacturing the carrier material is not considered essential to the present invention. Preferred carrier material may, for example, comprise alumina or silica-alumina. Suitable metallic components having hydrogenation activity are those selected from the group consisting of the metals of Groups VIB and VIII of the Periodic Table, as set forth in the *Periodic Table of the Elements,* E. H. Sargent & Co., 1964. Thus, the catalytic composites may comprise one or more metallic components from the group of molybdenum, tungsten, chromium, iron, cobalt, nickel, platinum, iridium, osmium, rhodium, ruthenium, and mixtures thereof. The concentration of the catalytically active metallic component, or components, is primarily dependent upon a particular metal as well as the physical and/or chemical characteristics of the particular charge stocks. For example, the metallic components of Group VIB are generally present in an amount within the range of from about 1 to about 20 wt. %, the iron-group metals in an amount within the range of about 0.2 to about 10 wt. %, whereas the noble metals of Group VIII are preferably present in an amount within the range of from about 0.1 to about 5 wt. %, all of which are calculated as if these components existed within the catalytic composite in the elemental state.

After the catalytic hydrotreating of the middle distillate stream having olefinic hydrocarbonaceous compounds to saturate at least a portion of the olefinic hydrocarbonaceous compounds as hereinabove described, a high quality middle distillate is recovered while simultaneously minimizing hydrogen consumption.

The resulting distillable bottoms stream boiling at a temperature greater than about 700° F. (371° C.) recovered from the fractional distillation column following the first non-catalytic thermal reaction zone, as described above, is then introduced into a mild catalytic hydrocracking zone which is operated at conditions selected to minimize the production of naphtha and lower boiling hydrocarbons, and the consumption of hydrogen while maximizing the production of high quality middle distillate which is recovered in a subsequent separation zone comprising a fractional distillation column. This mild hydrocracking is conducted in the presence of hydrogen and is preferably maintained at conditions which include an imposed pressure of from about 500 psig (3447 kPa gauge) to about 3000 psig (20,685 kPa gauge) and more preferably under a pressure from about 500 psig (3447 kPa gauge) to about 2000 psig (13,790 kPa gauge), a maximum catalyst bed temperature in the range of about 600° F. (315° C.) to about 850°F. (454° C.), a liquid hourly space velocity in the range from about 0.2 $hr^{-1}$ to about 10 $hr^{-1}$ and a hydrogen circulation rate from about 500 SCFB (88.9 standard $m^3/m^3$) to about 10,000 SCFB (1778 standard $m^3/m^3$).

The catalytic composite disposed within the mild catalytic hydrocracking zone can be characterized as containing a metallic component having hydrocracking and hydrogenation activity, which component is combined with a suitable refractory inorganic oxide carrier material of either synthetic or a natural origin. The precise composition and method of manufacturing the carrier material is not considered essential to the present invention. Preferred carrier material may, for example, comprise alumina, silica, silica-alumina, crystalline aluminosilicate or mixtures thereof. Suitable metallic components having hydrocracking and hydrogenation activity are those selected from the group consisting of the metals of Groups VIB and VIII of the Periodic Table, as set forth in the *Periodic Table of the Elements,* E. H. Sargent & Co., 1964. Thus, the catalytic composites may comprise one or more metallic components from the group of molybdenum, tungsten, chromium, iron, cobalt, nickel, platinum, iridium, osmium, rhodium, ruthenium, and mixtures thereof. The concentration of the catalytically active metallic component, or components, is primarily dependent upon a particular metal as well as the physical and/or chemical characteristics of the particular charge stocks. For example, the metallic components of Group VIB are generally present in an amount within the range of from about 1 to about 20 wt. %, the iron-group metals in an amount within the range of about 0.2 to about 10 wt. %, whereas the noble metals of Group VIII are preferably present in an amount within the range of from about 0.1 to about 5 wt. %, all of which are calculated as if these components existed within the catalytic composite in the elemental state.

The resulting effluent from the mild catalytic hydrocracking zone is preferably separated in a fractional distillation column to provide a low boiling hydrocarbonaceous stream comprising naphtha and lower boiling hydrocarbons, a middle distillate stream boiling in the range from about 300° F. (149° C.) to about 700° F. (371° C.) and a heavy hydrocarbonaceous stream boiling above the range of middle distillate and preferably above about 700° F. (371° C.).

The flash drum bottoms stream comprising non-distillable hydrocarbonaceous compounds as described hereinabove is introduced into a separation zone comprising a vacuum distillation tower to produce a vacuum gas oil stream preferably having a boiling range from about 700° F. (371° C.) to about 1050° F. (565° C.) and a vacuum tower bottoms stream comprising asphaltic components. The resulting vacuum gas oil stream is subsequently introduced into the hereinabove described mild catalytic hydrocracking zone.

The resulting vacuum tower bottoms stream is introduced into a deasphalting zone comprising a solvent deasphalter. In accordance with the present invention, the solvent deasphalter is used for the removal of asphaltic materials from the vacuum tower bottoms stream. Asphaltic material is generally associated with sulfur and various metals, such as nickel or vanadium. The asphaltic materials are high molecular weight, non-distillable coke precursors which are insoluble in light hydrocarbons such as pentane or heptane. Basic to the solvent deasphalter is the countercurrent contacting of the vacuum tower bottoms feed stream with a rising deasphalting solvent stream. The solvent may be any suitable hydrocarbonaceous material which is a liquid within suitable temperature and pressure ranges for operation of the countercurrent contacting column, is less dense than the feed stream, and has the ability to readily and selectively dissolve desired components of the feed stream and reject the asphaltic materials also commonly known as pitch. The solvent may be a mixture of a large number of different hydrocarbons having from 5 to 14 carbon atoms per molecule, such as a light naphtha having an end boiling point below about 200° F. (93° C.). The solvent may be a relatively light hydrocarbon such as ethane, propane, butane, isobutane, isopentane, hexane, heptane, the corresponding mono-olefinic hydrocarbons or mixtures thereof. Preferably, the solvent is comprised of paraffinic hydrocarbons having from 3 to 7 carbon atoms per molecule and can be a mixture of 2 or more hydrocarbons. For instance, a preferred solvent comprises a 50 volume percent mixture of normal butane and isopentane.

The solvent deasphalting conditions include a temperature from about 50° F. (10° C.) to about 600° F. (315° C.) or higher, but the deasphalter operation is preferably performed within the temperature range of 100° F. (38° C.)–400° F. (204° C.). The pressures utilized in the solvent deasphalter are preferably sufficient to maintain liquid phase conditions, with no advantage being apparent to the use of elevated pressures which greatly exceed this minimum. A broad range of suitable pressures is from about 100 psig (689 kPa gauge) to 1000 psig (6895 kPa gauge) with a preferred range being from about 200 psig (1379 kPa gauge) to 600 psig (4137 kPa gauge). An excess of solvent to charge stock should preferably be maintained. The solvent to charge stock volumetric ratio should preferably be between 2:1 to about 20:1 and preferably from about 3:1 to about 9:1. The preferred residence time of the charge stock in the solvent deasphalter is from about 10 to about 60 minutes.

The resulting deasphalted oil produced in the solvent deasphalter is also introduced into the mild catalytic hydrocracking zone as hereinabove described. The resulting asphaltic pitch is recovered from the solvent deasphalter and used elsewhere.

The hereinabove mentioned fractional distillation column which is used to separate the hydrocarbonaceous effluent from the mild catalytic hydrocracking zone to produce high quality middle distillate is also utilized to produce a heavy hydrocarbonaceous stream boiling above the range of middle distillate and preferably above about 700° F. (371° C.). This resulting heavy hydrocarbonaceous stream is reacted in a second non-catalytic thermal reaction zone at thermal cracking conditions including an elevated temperature in the range of from about 700° F. (371° C.) to about 950° F. (510° C.), a pressure from about 30 psig (207 kPa gauge) to about 1000 psig (6895 kPa gauge) and equivalent residence time at 900° F. (482° C.) from about 1 to about 120 seconds and more preferably from about 5 to about 90 seconds. More preferably, the non-catalytic thermal reaction zone is conducted at a pressure from about 50 psig (345 kPa gauge) to about 500 psig (3447 kPa gauge). Although the operating conditions of the second non-catalytic thermal reaction zone are very similar to those employed in the hereinabove first non-catalytic thermal reaction zone, the operating conditions employed in the second reaction zone can generally be more severe since the feedstock to this thermal reaction zone will contain little, if any, asphaltic hydrocarbonaceous compounds. Those skilled in the art of hydrocarbon processing, in light of the teachings of the present invention, will be readily able to select appropriate non-catalytic thermal reaction conditions suitable for the maximization of middle distillate boiling range hydrocarbon product streams.

The resulting effluent from the second non-catalytic thermal reaction zone is preferably separated to provide distillable, olefinic hydrocarbonaceous compounds and a stream of thermal tar. A preferred method for the separation of the effluent from the second non-catalytic thermal reaction zone is to introduce the effluent stream into a flash drum which is preferably maintained at an elevated temperature which is below the temperature maintained in the thermal reaction zone and further selected to provide an overhead stream which comprises hydrocarbons boiling at a temperature up to about 1050° F. (565° C.) and a flash drum bottoms stream comprising non-distillable hydrocarbonaceous compounds. The flash drum overhead stream is preferably introduced into the fractional distillation column associated with the effluent from the first non-catalytic thermal reaction zone as described hereinabove which eliminates the requirement for an additional separation zone or fractionation column. The flash drum bottoms stream is introduced into a vacuum flash drum to remove any remaining distillable hydrocarbon compounds as an overhead stream which is preferably introduced into the vacuum distillation tower associated with the effluent from the first non-catalytic thermal reaction zone. Thermal tar is recovered as a vacuum flash drum bottoms stream.

By introducing the flash drum overhead and the vacuum flash drum overhead streams from the second non-catalytic thermal reaction zone into the fractional distillation column and vacuum distillation tower associated with the effluent from the first non-catalytic thermal reaction zone, the unconverted distillable hydrocarbons boiling from about 700° F. (371° C.) to about 1050° F. (565° C.) are recycled to the mild catalytic hydrocracking zone as hereinabove described. By recycling distillable hydrocarbons boiling from about 700° F. (371° C.) to about 1050° F.(565° C.) through the mild catalytic hydrocracking zone and the second non-catalytic thermal reaction zone, the conversion severity per pass can be maintained at a low level while effecting a high overall conversion. Conversion selectivity to middle distillate is maximized when the conversion severity per pass is low.

In the drawing, one embodiment of the present invention is illustrated by means of a simplified flow diagram in which such details as pumps, instrumentation, heat-exchange and heat-recovery circuits, compressors and similar hardware have been deleted as being non-essential to an understanding of the techniques involved in the maximumization of middle distillate products from a residual asphaltene-containing hydrocarbonaceous feedstock. The use of such miscellaneous appurtenances are well within the purview of one skilled in the art of petroleum refining techniques. Only those vessels and lines necessary for a complete and clear understanding of the process of the present invention are illustrated with any obvious modifications made by those skilled in the art being included within the generally broad scope of the present invention.

Referring now to the drawing, a residual asphaltene-containing hydrocarbonaceous charge stock in the amount of 10,000 units (tons per day) is introduced into the process via conduit 1 and is charged to a first non-catalytic thermal cracker 2 which is operated at conditions selected to maximize the production of middle distillate and to minimize formation of coke products. The resulting effluent from the first non-catalytic thermal cracker 2 is removed via conduit 3 and introduced into flash drum 4 operated at conditions suitable to provide a hydrocarbonaceous stream comprising middle distillate and boiling less than a temperature of about 1050° F. (565° C.) in the amount of 2545 units which stream is removed via conduit 5 and introduced into fractionator 7. A non-distillable hydrocarbonaceous stream in the amount of 7455 units is removed from flash drum 4 via conduit 6 and introduced into vacuum tower 13. Fractionator 7 is operated in a manner to provide a low boiling hydrocarbonaceous stream comprising naphtha and lower boiling hydrocarbons in the amount of 820 units which is removed via conduit 8. A middle distillate stream and boiling in the range of about 300° F. (149° C.) to about 700° F. (371° C.) in the amount of 4530 units is removed from fractionator 7 via conduit 9 and introduced into hydrogenation zone 11. A distillable bottoms stream boiling at a temperature greater than about 700° F. (371° C.) in the amount of 1769 units is removed from fractionator 7 via conduit 10 and introduced into hydrocracking zone 16 via conduits 10, 23 and 14. Hydrogenation zone 11 contains a hydrogenation catalyst comprising alumina, cobalt and molybdenum which is operated at hydrogenation conditions sufficient to hydrogenate at least a portion of the olefinic hydrocarbons which were produced in thermal cracker 2 in order to produce a high quality middle distillate stream in the amount of 4548 units which is removed from hydrogenation zone 11 via conduit 12. Hydrogen consumption in hydrogenation zone 11 is 18 units.

A vacuum gas oil stream in the amount of 4421 units is prepared in vacuum tower 13 amd transferred via conduit 14 into hydrocracking zone 16. This vacuum gas oil stream and the hereinabove described distillate bottoms stream which is introduced via conduits 10, 23 and 14, and a deasphalted hydrocarbonaceous stream in the amount of 1536 units, as described hereinafter, are subjected to mild hydrocracking in the presence of a hydrocracking catalyst comprising silica, alumina, cobalt and molybdenum at hydrocracking conditions selected to maximize middle distillate production. Hydrogen consumption in hydrocracking zone 16 is 49 units. A hydrocarbonaceous effluent stream is removed from hydrocracking zone 16 via conduit 17 and introduced into fractionator 18 which is operated under conditions to provide a low boiling hydrocarbonaceous stream comprising naphtha and lower boiling hydrocarbons in the amount of 172 units which are removed via conduit 19 and a middle distillate stream preferably boiling in the range of about 300° F. (149° C.) to about 700° F. (371° C.) in the amount of 1060 units which is removed from fractionator 18 via conduits 20 and 12. A heavy hydrocarbonaceous stream boiling above the range of middle distillate and preferably above about 700°0 F. (371° C.) in the amount of 6544 units is removed from fractionator 18 via conduit 21 and introduced into a second non-catalytic thermal cracker 25 which is operated at conditions selected to maximize the production of hydrocarbons defined as middle distillate. The hydrocarbonaceous effluent from thermal cracker 25 is transferred via conduit 26 to flash drum 27 which is operated at conditions to provide a distillable, olefinic hydrocarbonaceous stream in the amount of 4574 units which is removed via conduit 28 and introduced into fractionator 7 and to provide a flash drum bottoms stream comprising non-distillable hydrocarbonaceous compounds in the amount of 1970 units which are removed via conduit 29 and introduced into vacuum flash drum 30 which is operated at conditions to remove any remaining distillable hydrocarbonaceous compounds via conduit 31 which are then introduced into vacuum tower 13. A thermal tar stream in the amount of 1085 units is recovered from vacuum flash drum 30 via conduit 32.

A vacuum bottoms stream in the amount of 3919 units is removed from vacuum tower 13 via conduit 15 and introduced into deasphalter 22. A deasphalted hydrocarbonaceous stream in the amount of 1536 units is removed from deasphalter 22 via conduit 23 and introduced into hydrocracking zone 16 via conduits 23 and 14. The hydrocarbonaceous feedstock to hydrocracking zone 16 comprises, as described hereinabove, a distillable bottoms stream from fractionator 7, a vacuum gas oil stream from vacuum tower 13 and a deasphalted hydrocarbonaceous stream from deasphalter 22. A deasphalter pitch stream is recovered from deasphalter 22 via conduit 24 in the amount of 2382 units.

The foregoing description and drawing clearly illustrate the advantages encompassed by the process of the present invention and the benefits to be afforded with the use thereof.

I claim as my invention:

1. A process for the conversion of a residual asphaltene-containing hydrocarbonaceous charge stock to selectively produce large quantities of high quality middle distillate while minimizing hydrogen consumption which process comprises the steps of:

(a) reacting said residual asphaltene-containing hydrocarbonaceous charge stock in a first non-catalytic thermal reaction zone at thermal cracking conditions including an elevated temperature from about 700° F. (371° C.) to about 950° F. (510° C.), a pressure from about 15 psig (103 kpa gauge) to about 100 psig (689 kPa gauge) and an equivalent residence time at 900° F. (482° C.) from about 2 to about 30 seconds to provide a first non-catalytic thermal reaction zone effluent;

(b) passing said first non-catalytic thermal reaction zone effluent into a first separation zone operated at conditions which result in the separation of entering hydrocarbonaceous compounds to provide a first middle distillate stream having olefinic hydrocarbonaceous compounds, a first distillate hydrocarbonaceous stream boiling at a temperature greater than about 700° F. (371° C.) and a first non-distillable hydrocarbonaceous stream;

(c) hydrotreating said first middle distillate stream having olefinic hydrocarbonaceous compounds recovered in step (b) in a catalytic hydrotreating reaction zone at hydrotreating conditions to saturate at least a portion of said olefinic hydrocarbonaceous compounds to provide a first high quality middle distillate product stream;

(d) reacting said first distillate hydrocarbonaceous stream boiling at a temperature greater than about 700° F. (371° C.) with hydrogen, in a catalytic hydrocracking reaction zone, at hydrocracking conditions including a maximum catalyst bed temperature in the range of about 600° F. (315° C.) to about 850° F. (454° C.) selected to convert at least a portion of said first distillate hydrocarbonaceous stream to lower-boiling hydrocarbonaceous products;

(e) deasphalting said first non-distillable hydrocarbonaceous stream in a deasphalting zone at deasphalting conditions to produce a deasphalted oil stream and a pitch stream;

(f) reacting said deasphalted oil stream in said catalytic hydrocracking reaction zone of step (d);

(g) separating a hydrocarbonaceous effluent stream produced in said catalytic hydrocracking zone of step (d) to provide a second high quality middle distillate product stream and a hydrocarbonaceous stream boiling at a temperature greater than about 700° F. (371° C.) and comprising non-distillable deasphalted oil;

(h) reacting said hydrocarbonaceous stream boiling at a temperature greater than about 700° F. (371° C.) and comprising non-distillable deasphalted oil in a second non-catalytic thermal reaction zone at thermal cracking conditions including an elevated temperature from about 700° F. (371° C.) to about 950° F. (510° C.), a pressure from about 50 psig (345 kPa gauge) to about 400 psig (2756 kPa gauge) and an equivalent residence time at 900° F. (482° C.) from about 5 to about 90 seconds to provide a second non-catalytic thermal reaction zone effluent;

(i) passing said second non-catalytic thermal reaction zone effluent into a second separation zone operated at conditions to provide a thermal tar stream, a second middle distillate stream having olefinic hydrocarbonaceous compounds, and a second distillate hydrocarbon stream boiling at a temperature greater than about 700° F. (371° C.);

(j) passing at least a portion of said second middle distillate stream having olefinic hydrocarbonaceous compounds into said first separation zone; and (k) passing at least a portion of said second distillate hydrocarbon stream boiling at a temperature greater than about 700° F. (371° C.) into said first separation zone.

2. The process of claim 1 wherein said hydrotreating reaction zone contains a catalyst comprising a refractory inorganic oxide and at least one metal component selected from Groups VIB and VIII.

3. The process of claim 1 wherein said hydrotreating reaction zone contains a catalyst comprising alumina, cobalt and molybdenum.

4. The process of claim 1 wherein said hydrotreating conditions include a pressure from about 500 psig (3447 kPa gauge) to about 1600 psig (11,032 kPa gauge), a maximum catalyst bed temperature in the range from about 600° F. (315° C.) to about 850° F. (454° C.), a liquid hourly space velocity in the range from about 0.2 $hr^{-1}$ to about 10 $hr^{-1}$ and a hydrogen circulation rate from about 500 SCFB (88.9 standard $m^3/m^3$) to about 10,000 SCFB (1778 standard $m^3/m^3$).

5. The process of claim 1 wherein said catalytic hydrocracking reaction zone contains a hydrocracking catalyst comprising a refractory inorganic oxide and at least one metal component selected from Groups VIB and VIII.

6. The process of claim 1 wherein said catalytic hydrocracking reaction zone contains a catalyst comprising silica, alumina, cobalt and molybdenum.

7. The process of claim 1 wherein said hydrocracking conditions include a pressure from about 500 psig (3447 kPa gauge) to about 2000 psig (13,790 kPa gauge), a liquid hourly space velocity in the range from about 0.2 $hr^{-1}$ to about 10 $hr^{-1}$ and a hydrogen circulation rate from about 500 SCFB (99.8 standard $m^3/m^3$) to about 10,000 SCFB (1778 standard $m^3/m^3$).

8. The process of claim 1 wherein said deasphalting zone utilizes a deasphalting solvent comprising a mixture of hydrocarbons having from about 5 to about 14 carbon atoms per molecule.

9. The process of claim 1 wherein said deasphalting zone utilizes a deasphalting solvent comprising ethane, propane, butane, isobutane, isopentane, hexane, heptane, the corresponding mono-olefinic hydrocarbons or mixtures thereof.

10. The process of claim 1 wherein said deasphalting conditions include a temperature from about 50° F. (10° C.) to about 600° F. (315° C.), a pressure from about 100 psig (689 kPa gauge) to about 1000 psig (6895 kPa gauge), a solvent to charge stock volumetric ratio from about 2:1 to about 20:1 and a residence time of the charge stock from about 10 to about 60 minutes.

11. A process for the conversion of a residual asphaltene-containing hydrocarbonaceous charge stock to selectively produce large quantities of high quality middle distillate while minimizing hydrogen consumption which process comprises the steps of:

(a) reacting said residual asphaltene-containing hydrocarbonaceous charge stock in a first non-catalytic thermal reaction zone at thermal cracking conditions including an elevated temperature from about 700° F. (371° C.) to about 950° F. (510° C.) a pressure from about 15 psig (103 kPa gauge) to about 100 psig (689 kPa gauge) and an equivalent residence time at 900° F. (482° C.) from about 2 to about 30 seconds to provide a first non-catalytic thermal reaction zone effluent;

(b) separating said first non-catalytic thermal reaction zone effluent to provide a first middle distillate stream having olefinic hydrocarbonaceous compounds, a first distillate hydrocarbonaceous stream boiling at a temperature greater than about 700° F. (371° C.) and a first non-distillable hydrocarbonaceous stream;

(c) hydrotreating said first middle distillate stream having olefinic hydrocarbonaceous compounds recovered in step (b) in a catalytic hydrotreating reaction zone at hydrotreating conditions to saturate at least a portion of said olefinic hydrocarbonaceous compounds to provide a first high quality middle distillate product stream;

(d) reacting said first distillate hydrocarbonaceous stream boiling at a temperature greater than about 700° F. (371° C.) with hydrogen, in a catalytic hydrocracking reaction zone, at hydrocracking conditions including a maximum catalyst bed temperature in the range of about 600°0 F. (315° C.) to about 850° F. (454° C.) selected to convert at least a portion of said first distillate hydrocarbonaceous stream to lower-boiling hydrocarbonaceous products;

(e) deasphalting said first non-distillable hydrocarbonaceous stream in a deasphalting zone at deasphalting conditions to produce a deasphalted oil stream and a pitch stream;

(f) reacting said deasphalted oil stream in said catalytic hydrocracking reaction zone of step (d);

(g) separating a hydrocarbonaceous effluent stream produced in said catalytic hydrocracking zone of step (d) to provide a second high quality middle distillate product stream and a hydrocarbonaceous stream boiling at a temperature greater than about 700° F. (371° C.) and comprising non-distillable deasphalted oil;

(h) reacting said hydrocarbonaceous stream boiling at a temperature greater than about 700° F. (371° C.) and comprising non-distillable deasphalted oil in a second non-catalytic thermal reaction zone at thermal cracking conditions including an elevated temperature from about 700° F. (371° C.) to about 950° F. (510° C.), a pressure from about 50 psig (345 kPa gauge) to about 400 psig (2756 kPa gauge) and an equivalent residence time at 900° F. (482° C.) from about 5 to about 90 seconds to provide a second non-catalytic thermal reaction zone effluent;

(i) separating said second non-catalytic thermal reaction zone effluent to provide a thermal tar stream, a second middle distillate stream having olefinic hydrocarbonaceous compounds, and a second distillate hydrocarbon stream boiling at a temperature greater than about 700° F. (371° C.);

(j) hydrotreating at least a portion of said second middle distillate stream having olefinic hydrocarbonaceous compounds in said catalytic hydrotreating reaction zone of step (c); and (k) reacting at least a portion of said second distillate stream boiling above about 700° F. (371° C.) from step (i) in said catalytic hydrocracking reaction zone of step (d).

12. The process of claim 11 wherein said hydrotreating reaction zone contains a catalyst comprising a refractory inorganic oxide and at least one metal component selected from Groups VIB and VIII.

13. The process of claim 11 wherein said hydrotreating reaction zone contains a catalyst comprising alumina, cobalt and molybdenum.

14. The process of claim 11 wherein said hydrotreating conditions include a pressure from about 500 psig (3447 kPa gauge) to about 1600 psig (11,032 kPa gauge), a maximum catalyst bed temperature in the range from about 600° F. (315° C.) to about 850° F. (454° C.), a liquid hourly space velocity in the range from about 0.2 $hr^{-1}$ to about 10 $hr^{-1}$ and a hydrogen circulation rate from about 500 SCFB (88.9 standard $m^3/m^3$) to about 10,000 SCFB (1778 standard $m^3/m^3$).

15. The process of claim 11 wherein said catalytic hydrocracking reaction zone contains a hydrocracking catalyst comprising a refractory inorganic oxide and at least one metal component selected from Groups VIB and VIII.

16. The process of claim 11 wherein said catalytic hydrocracking reaction zone contains a catalyst comprising silica, alumina, cobalt and molybdenum.

17. The process of claim 11 wherein said hydrocracking conditions include a pressure from about 500 psig (3447 kPa gauge) to about 2000 psig (13,790 kPa gauge), a liquid hourly space velocity in the range from about 0.2 $hr^{-1}$ to about 10 $hr^{-1}$ and a hydrogen circulation rate from about 500 SCFB (99.8 standard $m^3/m^3$) to about 10, 000 SCFB (1778 standard $m^3/m^3$).

18. The process of claim 11 wherein said deasphalting zone utilizes a deasphalting solvent comprising a mixture of hydrocarbons having from about 5 to about 14 carbon atoms per molecule.

19. The process of claim 11 wherein said deasphalting zone utilizes a deasphalting solvent comprising ethane, propane, butane, isobutane, isopentane, hexane, heptane, the corresponding mono-olefinic hydrocarbons or mixtures thereof.

20. The process of claim 11 wherein said deasphalting conditions include a temperature from about 50° F. (10° C.) to about 600° F. (315° C.), a pressure from about 100 psig (689 kPa gauge) to about 1000 psig (6895 kPa gauge), a solvent to charge stock volumetric ratio from about 2:1 to about 20:1 and a residence time of the charge stock from about 10 to about 60 minutes.

* * * * *